US006918699B2

(12) United States Patent
Hanson

(10) Patent No.: US 6,918,699 B2
(45) Date of Patent: Jul. 19, 2005

(54) FLAT BOTTOM BAG WITH HANDLE

(76) Inventor: Violet Hanson, 170-40 Highland Ave., Jamaica, NY (US) 11432

( * ) Notice: Subject to any disclaimer, the term of this patent is extended or adjusted under 35 U.S.C. 154(b) by 0 days.

(21) Appl. No.: 09/755,702

(22) Filed: Jan. 5, 2001

(65) Prior Publication Data

US 2001/0021282 A1 Sep. 13, 2001

Related U.S. Application Data

(62) Division of application No. 09/307,990, filed on May 10, 1999, now abandoned.

(51) Int. Cl.[7] ..... B65D 33/10

(52) U.S. Cl. ..... 383/8; 383/14; 383/17; 383/104; 383/119; 383/120; 383/121

(58) Field of Search ..... 383/8, 14, 119, 383/120, 77, 121, 17, 104

(56) References Cited

U.S. PATENT DOCUMENTS

| | | | | | |
|---|---|---|---|---|---|
| 1,015,007 | A | * | 1/1912 | Cutler | 383/120 |
| 1,948,569 | A | * | 2/1934 | Falk | 383/121 |
| 1,951,011 | A | * | 3/1934 | Falk | 383/126 |
| 2,432,122 | A | * | 12/1947 | Pardee | 493/59 |
| 4,571,235 | A | * | 2/1986 | Benoit | 493/195 |
| 5,149,201 | A | * | 9/1992 | Benoit | |
| 5,580,173 | A | * | 12/1996 | Sebastian | 383/76 |
| 5,836,696 | A | * | 11/1998 | Schnell | 383/120 |
| 6,195,964 | B1 | * | 3/2001 | Kitao | 53/449 |

FOREIGN PATENT DOCUMENTS

| | | | | |
|---|---|---|---|---|
| CA | 002054309 A | * | 6/1992 | 383/120 |
| DE | 2436228 | * | 2/1975 | 383/119 |
| DE | 2526961 | * | 5/1976 | 383/120 |
| EP | 000519896 A | * | 12/1992 | 383/77 |
| FR | 1185229 | * | 7/1959 | 383/121 |
| FR | 1496589 | * | 9/1967 | 383/8 |

* cited by examiner

*Primary Examiner*—Jes F. Pascua
(74) *Attorney, Agent, or Firm*—Bernard S. Hoffman

(57) ABSTRACT

A tubular sleeve is shaped with a pair of opposing faces, a pair of opposing side walls, and a lowermost terminal edge. Double gussets are simultaneously formed on each opposing side walls of the shaped sleeve inward between the pair of opposing faces of the shaped sleeve and defining substantially square corners at intersection of the longitudinal ribs of the shaped sleeve and the lowermost terminal edge of the shaped sleeve. The square corners of the shaped sleeve are relieved and removed to form a flat bottom. A pair of handles are unitarily formed and integral with the frontal faces extending over the open top.

25 Claims, 4 Drawing Sheets

FLAT BOTTOM BAG WITH HANDLE

RELATED APPLICATION

The present application is a division of my originally filed application Ser. No. 09/307,990, filed May 10, 1999, entitled PLASTIC SHOPPING BAG. Ser. No. 09/307,990 is abandoned.

BACKGROUND OF THE INVENTION

The present invention relates to the construction of a flat bottom plastic shopping bag constructed unitarily with a handle and to the method for making the bag.

Plastic shopping bags have supplanted paper bags for use in supermarkets, and most retail establishments, because of their versatility, decorativeness and cheapness. Generally, such bags, have a disadvantage in that they are formed with hanging triangularly shaped bottoms and are thus difficult to fill. It has been attempted to provide plastic bags having flat bottoms, for more conveniently receiving grocery items, boxes and the like. Such bags, however, cannot be made inexpensively. Another problem with conventional plastic bags lies in the fact that they are not self supporting and therefore their opening or mouth is neither wide or distensible enough to make loading or filling of the bag easy.

In my prior patents, U.S. Pat. Nos. 3,988,970, 3,916,770 and 4,230,030, I have disclosed plastic bags and their manufacture in which flat bottoms have been formed. These serve to allow the bag to be neatly folded for stacking and shipping and also to be effective in filling the bag. The bags shown in these patents also have side gussets similarly designed to allow folding and stacking for shipping. The bags known from these patents, however, do not provide reinforced strong integrally and unitarily formed handles, by which the filled bag can be easily carried.

It is the object of the present invention to provide a plastic bag overcoming the disadvantages of the prior art bags.

It is a further object to provide a plastic shopping bag having an integrally formed handle allowing the user to carry a full bag with ease and comfort.

The foregoing objects together with other objects and advantages will be apparent from the following disclosure of the invention.

SUMMARY OF THE INVENTION

According to the present invention, the foregoing objects and advantages are obtained by forming a plastic bag with a generally rectangular cross section having multiple gusseted side walls and a flat bottom.

The plastic bag comprises a tubular sleeve shaped to be rectangular in transverse cross section and having a pair of opposing faces and a pair of end walls. Each end wall is formed with at least a pair of longitudinal gussets. The gussets are folded inwardly and the tubular sleeve flattened by pressing the opposing faces together. In this condition the corners formed by the intersection of the lower edge and the side walls are removed, and the side walls and the bottom are further sealed and shaped to form the closed flat bottom.

The bag is finished by providing it with a unitary integral handle by cutting or scoring the bag along a line from the side walls toward but spaced from the central longitudinal axis and spaced below the topmost edge of the plastic. In use the plastic sheet is separated along the score or cut lines freeing the material in the space above the score or cut lines, thus forming a handle. Reinforcement ribs or seal members and the like can be provided to strengthen the material particularly at the juncture of the handle, score lines, etc.

Full details of the present invention are set forth in the following description and shown in the accompanying drawing.

DESCRIPTION OF THE INVENTION

Figure 1:
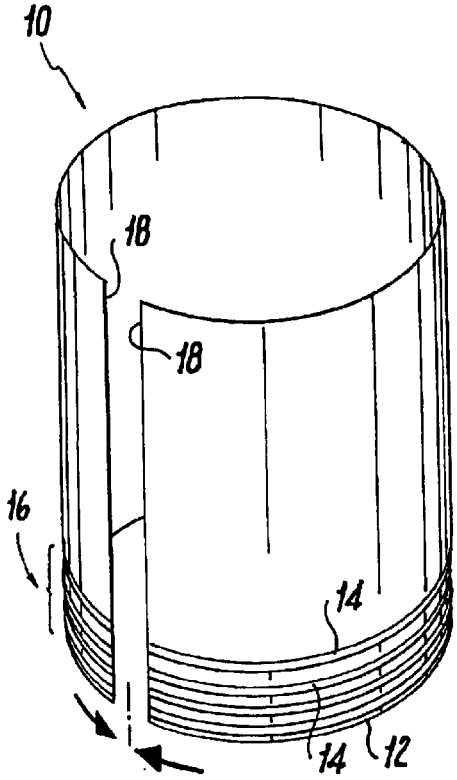
FIG. 1 is a perspective view of a plastic sheet rolled into a cylindrical tube.
Figure 2:
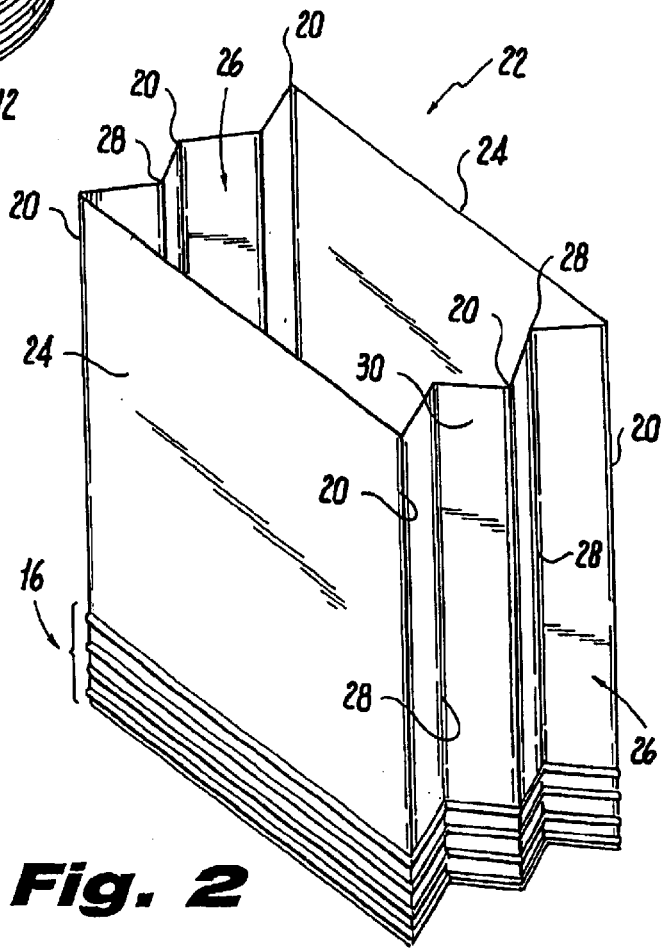
FIG. 2 is a similar view showing the cylindrical tube formed into a rectangular tubular sleeve having frontal faces, end walls and double gussets.
Figure 3:
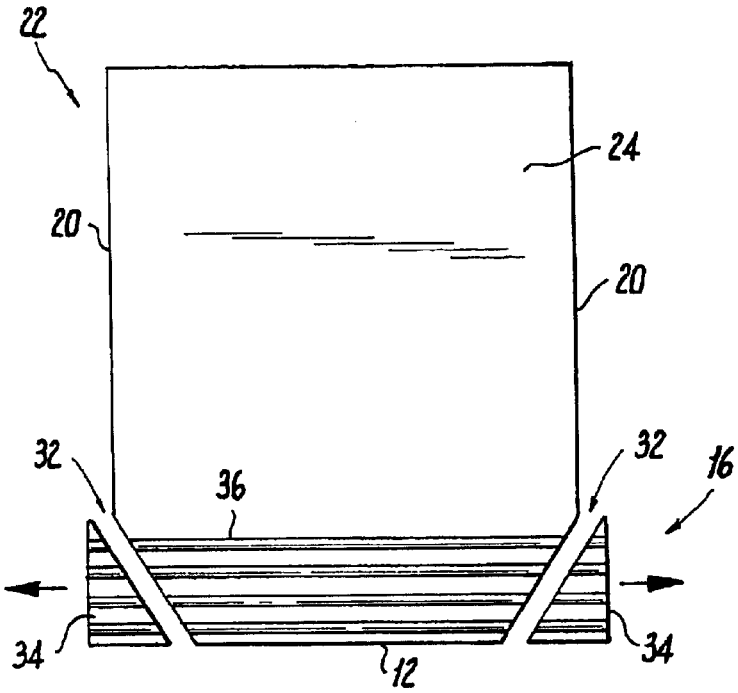
FIG. 3 is a planar view of the tubular sleeve, illustrated in FIG. 3 showing the sleeve in flattened form and the bottom corners removed.
Figure 4:
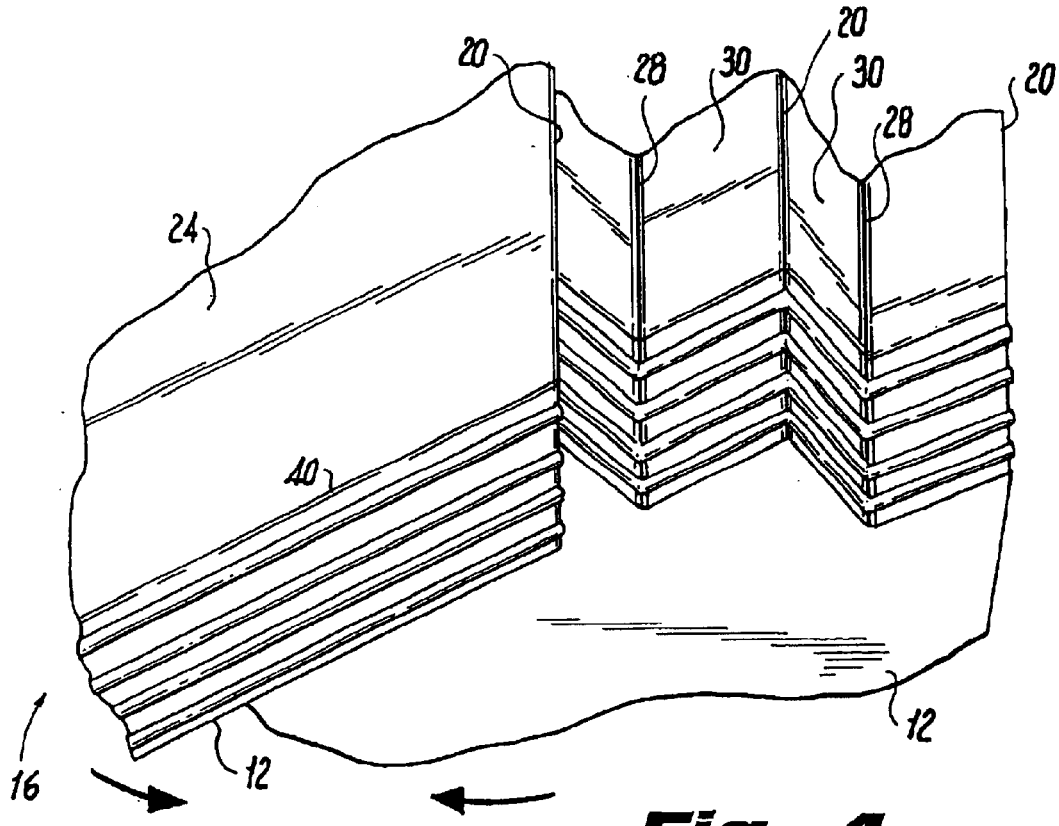
FIG. 4 is a perspective view particularly cross sectioned showing the lower portion of the bag with its relieved lower corners being folded over the flat bottom in forming the bottom wall.

The resultant bag of the present invention will be most easily understood by first detailing the several steps depicted in FIGS. 1–6 by which the bag is made.

In accordance with the present invention, a cylinder 10 is formed on an endless sheet of plastic film, suitable for use as a commercial shopping bag. The sheet 10 was initially laid flat and cut to the desired longitudinal size, and in this flat condition, the bottom edge 12 is passed through a heating or shaping unit where several ribs and/or seal blocks 14 are formed in a uniform spaced arrangement in a relatively wide band 16 adjacent the edge 12. The ribs and/or seal blocks 14 strengthen the film and serve to form a reinforced bottom, as will be described.

The sheet 10, rolled into a cylinder, is then sealed along the longitudinal adjoining edge 18 to provide a unitary cylindrical body, open at both ends. The cylindrical body is thereafter placed into a forming or creasing machine in which a plurality of longitudinal edges 20 are formed "squaring" the cylindrical body into a tubular sleeve 22 having a rectangular cross-sectional configuration with opposed frontal faces 24 and opposed narrower end walls 26. At the same time that the edges 20 are formed and the body squared, the end walls 26 are each folded along longitudinal gusset rib 28 to form with the longitudinal edges 20, a pair of gussets 30 having alternating longitudinal ribs and folds. Preferably, the ribs 20 are reinforced by heat to form a somewhat rigid longitudinal back, which allows the sleeve to stand when opened.

The bag is once again laid generally flat (FIG. 3) with the bottom edge 12 open and the gussets 30 running completely along the length of the bag. At this stage, with the closed gussets 30 in place, the bag is sealed at its bottom edge 12 thereby closing the tubular sleeve 22. (See FIG. 5). Simultaneously, angular inwardly directed cuts 32 are made, severing the corners 34 of the bag at the intersection of the bottom 12 and longitudinal edges 20. The severed corners 34 are removed and the adjacent tapered gusset folds 28 and the end ribs 20 are heat sealed to each other and to the bottom edge 12 insuring that the bag's integrity is reestablished (See FIG. 5).

Figure 5:
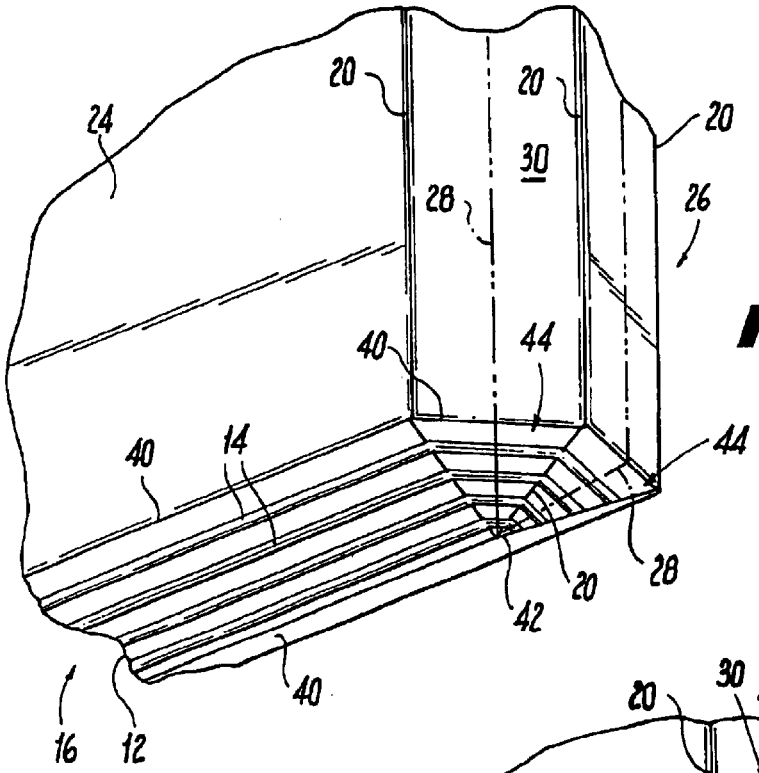
FIG. 5 is a perspective view looking at the bottom wall with the relieved corners seated together forming the flat bottom.
Figure 6:
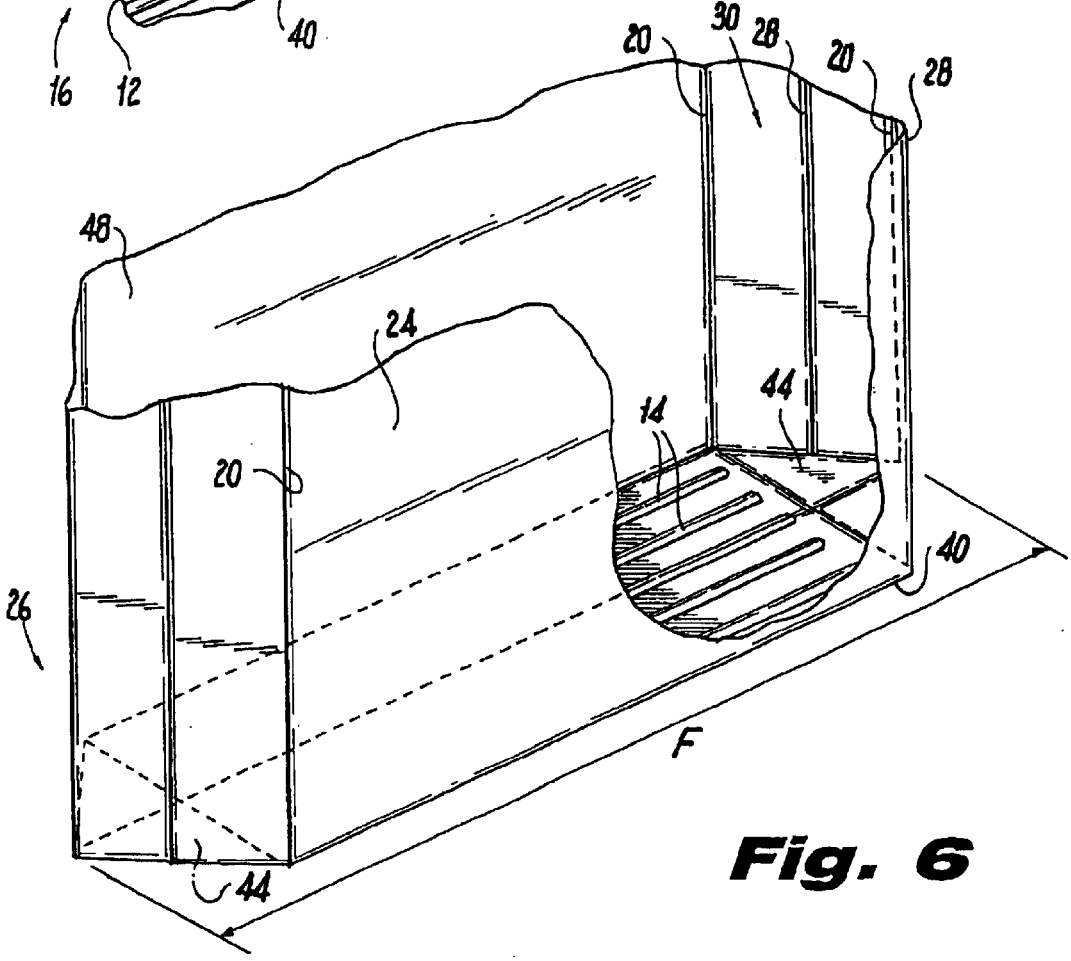
FIG. 6 is an isometric view partially broken away to show its interior and illustrating the distention and ballooning of the gussets.

Lastly a folder or mandrel is employed to form and flatten the bottom wall, about a horizontal line 40 approximately at the point 42 where the upper edge of the cut 32 intersects the gusset ribs. Because the angular cut edges of the gusset ribs and folds are sealed, the side walls 26 are pulled downwardly into the plane of the bottom of the sections 42 and 44 to provide triangular sections defining laterally extending wing portions 44 at the bottom wall, as seen in FIGS. 5 and 6, so that the bottom wall is formed by connecting to each other the bottom part of each frontal face 24 and the bottom part of each gusset 30, without any overlapping with each other of the bottom part of each frontal face 24 and the bottom part of each gusset 30 when the bag is in an unfolded position. Consequently, once the bag is opened the "foot" F of the flat bottom bag (FIG. 6) is larger than the rectangular cross-sectional configuration of the tubular sleeve itself, resulting in a large volume bag without substantial increase in the sleeve diameter. It will also be seen that the ribs and block seals 14 formed in the bottom edge of the tubular sleeve (FIG. 2) now create a strong reinforcement for the bottom wall and extensions creating a firm, well defined rectangular foot. The seals along cuts 32, form reinforcing ribs strengthening the triangular extension wing portion 44.

Similarly as seen from FIG. 6, the mouth 48 or top edge of the bag is widened considerably once the bag is opened so as to allow more ready access into the bag itself. This is accomplished by the fact that when the bag is opened and the bottom wall flattened, the gusseted end walls 30 balloon outwardly and distend both transversely and laterally. Thus compared to a single gusseted bag, the present bag provides a substantially greater volume within the bag without increasing the tubular diameter of the flat dimensions of the bag. By reinforcing the longitudinal corners 28 with heat formed bead or seal, added vertical strength is provided allowing the bag to remain open without difficulty.

By forming the bag with double gussets, a wide mouth and wide body bag is formed easily and inexpensively. While two gussets are illustrated at each end it will be apparent, that more than two can be formed with little difficultly or modification. The gussets are actually smaller than would be expected and fold only a short distance inward between the frontal walls. When the bag is opened, the gussets however allow the bag to open squarely, i.e., the frontal walls and the side walls stand perpendicularly to the horizontal, even larger than the initial cross-section.

Although, multi-gussets are formed providing at least six layers of film, when laid flat, the bottom wall is not encumbered with material. This is so because the corners are cut on the bias and excess material removed. This has an added advantage, as well, when the bag is opened, the angular walls of the bottom can open wide forming in effect a part of the bag bottom; increasing the wide and flat bottom perfectly.

It will thus be seen that the present invention provides a plastic shopping bag comprising a tubular sleeve having a longitudinal axis, an open top and unitarily formed at its bottom edge with a continuous band of transverse reinforcing ribs and sealing blocks. The sleeve is folded with a rectangular cross section having a pair of side walls connecting said frontal faces, each of said side walls having at least one pair of longitudinal gussets. The folded sleeve is then provided with angular cuts extending downward and inward from the intersection of said frontal faces and said side faces with the top of said transverse band and the triangle thus formed is removed below the opposite side faces. The adjacent cut edges of said transverse band and the gussets of said side faces are sealed together so that when the sleeve is opened, the gussets in each of said side faces distends laterally from the frontal faces and a closed flat bottom, including the distendable gussets is then formed.

Figure 7:
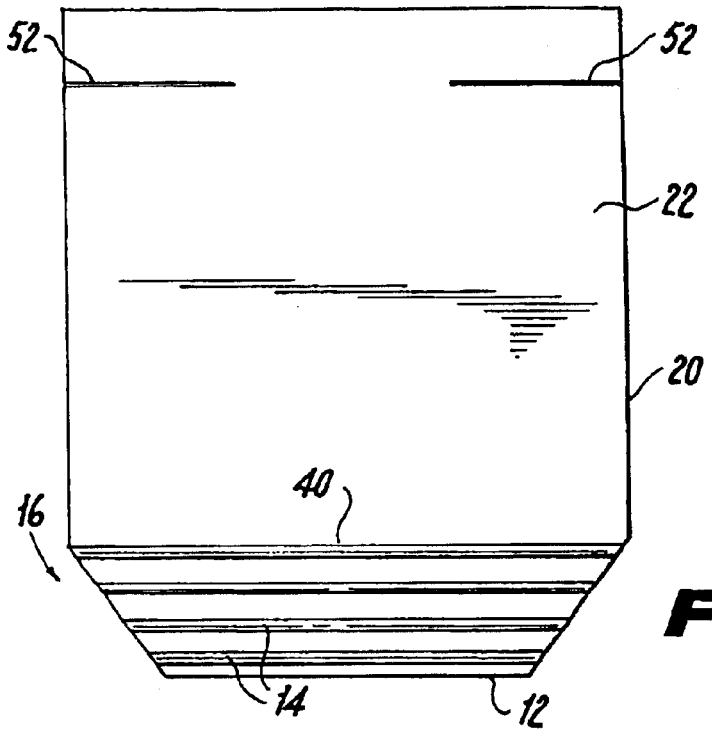
FIG. 7 is a view similar to that of FIG. 3 showing the formation of the handle for the bag.
Figure 8:
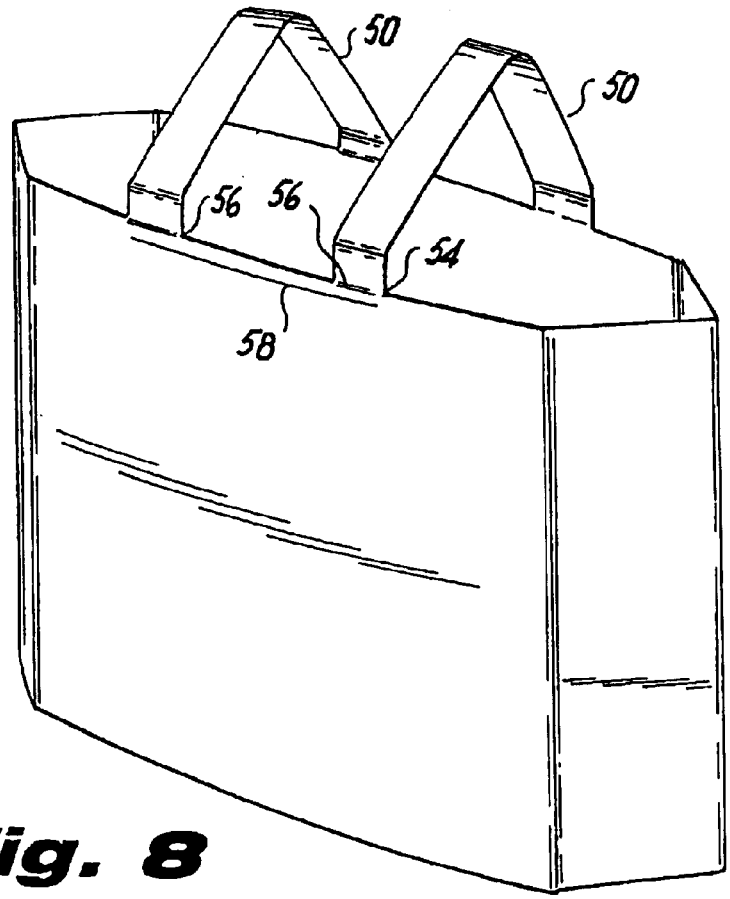
FIG. 8 is a view similar to FIG. 6 showing the bag with handle open.

The present bag is provided with self or integral handles 50 as seen in FIGS. 7 and 8. In the flat condition, the gusseted tubular sleeve 22 or the finished bag is scored or cut along the transverse lines 52 from each end wall inwardly toward each other for a selected distance, terminating spaced from the central longitudinal axis of the frontal faces. This produces a pair of spaced handles 50 integrally and unitarily formed at 54 with the frontal faces 24 of the bag. To insure that the handles 52 do not tear away from the frontal faces reinforcing ribs 56, reinforced edges or the like may be made at the corners 58 or along the longitudinal junction 54 of the handle and the bag, by heat sealing the edges, adding additional material or other conventional means. The scoring or cutting as well as the reinforcement of the handles can be affected simultaneously with the formation of the flat bottom bag.

While the invention has been illustrated and described as embodied in a method of making a bag having a flat bottom and double or more side gussets, however, it is not limited to the details shown, since it will be understood that various omissions, modifications, substitutions and changes in the forms and details of the device illustrated and its operation can be made by those skilled in the art without departing in any way from the spirit of the claims attached.

What is claimed is:

1. A gusset bag, said bag comprising:

a) a front face;

b) a back face;

c) a pair of opposing end walls;

d) a bottom; and e) a pair of handles;

wherein said pair of opposing end walls and said bottom connect said front face to said back face;

wherein said pair of opposing end walls have gussets;

wherein said front face has a bottom part;

wherein said back face has a bottom part;

wherein each gusset has a bottom part;

wherein said bottom is formed by connecting to each other said bottom part of said front face, said bottom part of said back face, and said bottom part of each gusset, without any overlapping with each other of said bottom part of said front face, said bottom part of said back face, and said bottom part of each gusset when said bag is in an unfolded position;

wherein each end wall has a top edge;

wherein said front face has a central longitudinal axis;

wherein said front face has a top;

wherein said back face has a central longitudinal axis;

wherein said back face has a top;

wherein each handle is formed by providing a cut from a predetermined position below said top edge of a respective end wall laterally towards, but spaced from, said central longitudinal axis of said front face and said central longitudinal axis of said back face, and lifting each handle thus formed into a vertical position where each handle has a juncture at said top of said front face and said top of said back face; and wherein said pair of handles thus formed are integral and unitary to the gusset bag.

2. The gusset bag as defined in claim 1, wherein said bottom part of each gusset is a triangular bottom part;

wherein said triangular bottom part of said bottom part of each gusset has a first edge;

wherein said triangular bottom part of said bottom part of each gusset has a second edge;

wherein said bottom part of said front face has a bottom edge;

wherein said bottom part of said back face has a bottom edge;

wherein said front face has a pair of side edges;

wherein each side edge of said front face has a bottom part;

wherein said back face has a pair of side edges;

wherein each side edge of said back face has a bottom part; and wherein said bottom is formed by connecting said bottom edge of said bottom part of said front face directly to said bottom edge of said bottom part of said back face, connecting said first edges of said triangular bottom parts of said bottom parts of adjacent gussets directly to each other, and connecting said second edge of said triangular bottom part of said bottom part of each gusset directly to said bottom part of an adjacent side edge of an adjacent one of said front face and said back face.

3. The bag as defined in claim 2, wherein said bottom edge of said bottom part of said front face is sealed directly to said bottom edge of said bottom part of said back face;

wherein said first edges of said triangular bottom parts of said bottom parts of adjacent gussets are sealed directly to each other; and wherein said second edge of said triangular bottom part of said bottom part of each gusset is sealed directly to said bottom part of an adjacent side edge of an adjacent one of said front face and said back face.

4. The bag as defined in claim 2, wherein said first edge of said triangular bottom part of said bottom part of each gusset has a length;

wherein said second edge of said triangular bottom part of said bottom part of each gusset has a length;

wherein said bottom part of each side edge of said front face has a length;

wherein said bottom part of each side edge of said back face has a length; and wherein said length of each of said bottom part of each side edge of said front face and said bottom part of each side edge of said back face is equal to said length of each of said first edge of said triangular bottom part of said bottom part of each gusset and said second edge of said triangular bottom part of said bottom part of each gusset.

5. The gusset bag as defined in claim 2, wherein said gusset bag has a folded position;

wherein said gussets are folded inwardly when said gusset bag is in said folded position thereof;

wherein said bottom folds inwardly between said front face and said back face when said gusset bag is in said folded position thereof; and wherein said front face and said back face lie against each other when said gusset bag is in said folded position thereof.

6. The gusset bag as defined in claim 5, wherein corners formed by intersection of said bottom edge of said bottom part of said front face and said bottom edge of said bottom part of said back face with said pair of opposing end walls are nonexistent when said gusset bag is in said folded position thereof.

7. The gusset bag as defined in claim 1, wherein said gusset bag has an unfolded position;

wherein said unfolded position of said gusset bag has an overall width;

wherein said front face has a width;

wherein said back face has a width; and wherein said overall width of said unfolded position of said gusset bag is greater than said width of each of said front face and said back face.

8. The bag as defined in claim 1, wherein said gusset bag has an unfolded position;

wherein said unfolded position of said gusset bag has an overall width; and wherein said gussets of said pair of opposing end walls balloon outwardly and distend both transversely and laterally when said gusset bag is in said unfolded position thereof thereby causing said overall width of said unfolded position of said gusset bag to be greater than said width of each of said front face and said back face.

9. The bag as defined in claim 1, wherein said gusset bag has an unfolded position;

wherein said bottom is flat when said gusset bag is in said unfolded position thereof; and wherein said gussets are unfolded when said gusset bag is in said unfolded position thereof.

10. The bag as defined in claim 1, wherein said bottom has a plurality of reinforcements; and wherein said plurality of reinforcements of said bottom strengthen said bottom by serving to form a reinforced bottom.

11. The bag as defined in claim 10, wherein said plurality of reinforcements of said bottom are reinforcing ribs.

12. The bag as defined in claim 11, wherein said reinforcing ribs of said plurality of reinforcements of said bottom are uniformly spaced-apart from each other.

13. The bag as defined in claim 10, wherein said plurality of reinforcements of said bottom are sealing blocks.

14. The bag as defined in claim 13, wherein said sealing blocks of said plurality of reinforcements of said bottom are uniformly spaced-apart from each other.

15. The gusset bag as defined in claim 10, wherein said front face has a fold edge;

wherein said back face has a fold edge;

wherein each gusset has a triangular bottom part;

wherein said triangular bottom part of each gusset has a fold edge; and wherein said bottom is defined by said fold edge of said front face, said fold edge of said back face, and said fold edge of said triangular bottom part of each gusset.

16. The gusset bag as defined in claim 15, wherein said plurality of reinforcements of said bottom extend along said fold edge of said front face, said fold edge of said back face, and said fold edge of said triangular bottom part of each gusset so as to form a strong reinforcement for the bottom creating a firm, well defined bottom.

17. The gusset bag as defined in claim 1, wherein each handle has reinforcements;

wherein said reinforcements of each handle are at said juncture of each handle; and wherein said reinforcements of each handle strengthen said juncture of each handle and prevent each handle from tearing away from an associated one of said front face and said back face.

18. The gusset bag as defined in claim 17, wherein said reinforcements of each handle are reinforcing ribs.

19. The gusset bag as defined in claim 17, wherein said reinforcements of each handle are sealing members.

20. The gusset bag as defined in claim 1, wherein said gusset bag has an unfolded position;

wherein said front face has a pair of side edges;

wherein said back face has a pair of side edges; and wherein said pair of side edges of said front face are heat reinforced and said pair of side edges of said back face are heat reinforced so as to rigidify said gusset bag and allow said gusset bag to stand when in said unfolded position thereof.

21. The gusset bag as defined in claim 1, wherein each end wall has a height; and wherein said gussets extend completely along said height of each end wall.

22. The gusset bag as defined in claim 1, wherein said gussets of each end wall are at least double gussets.

23. The gusset bag as defined in claim 1, wherein said gusset bag is made of plastic.

24. A gusset bag, said bag comprising;

a) a front face b) a back face;

c) a pair of opposing end walls; and d) a bottom;

wherein said pair of opposing end walls and said bottom connect said front face to said back face;

wherein said pair of opposing end walls have gussets;

wherein said front face has a bottom part;

wherein said back face has a bottom part, wherein each gusset has a bottom part;

wherein said bottom is formed by connecting to each other said bottom part of said front face, said bottom part of said back face, and said bottom part of each gusset;

wherein said gusset bag has an unfolded position;

wherein said bottom is formed by connecting to each other said bottom part of said front face, said bottom part of said back face, and said bottom part of each gusset, without any overlapping with each other of said bottom part of said front face, said bottom part of said back face, and said bottom part of each gusset when said bag is in said unfolded position thereof;

wherein said front face has a pair of side edges;

wherein said back face has a pair of side edges; and wherein said pair of side edges of said front face are heat reinforced and said pair of side edges of said back face are heat reinforced so as to rigidify said gusset bag and allow said gusset bag to stand when in said unfolded position thereof.

25. A gusset bag, said bag comprising:

a) a front face;

b) a back face;

c) a pair of opposing end walls; and d) a bottom, wherein said pair of opposing end walls and said bottom connect said front face to said back face;

wherein said pair of opposing end walls have gussets;

wherein said front face has a bottom part;

wherein said back face has a bottom part;

wherein each gusset has a bottom part;

wherein said bottom is formed by connecting to each other said bottom part of said front face, said bottom part of said back face, and said bottom part of each gusset, without any overlapping with each other at said bottom part of said front face, said bottom part of said back face, and said bottom part of each gusset when said bag is in an unfolded position;

wherein said bottom part of each gusset is a triangular bottom part;

wherein said triangular bottom part of said bottom part of each gusset has a first edge:

wherein said triangular bottom part of said bottom part of each gusset has a second edge;

wherein said front face has a pair of side edges;

wherein each side edge of said front face has a bottom part;

wherein said back face has a pair of side edges;

wherein each side edge of said back face has a bottom part;

wherein said first edge of said triangular bottom part of said bottom part of each gusset has a length;

wherein said second edge of said triangular bottom part of said, bottom part of each gusset has a length;

wherein said bottom part of each side edge of said front face has a length;

wherein said bottom part of each side edge of said back face has a length; and wherein said length of each of said bottom part of each side edge of said front face and said bottom part of each side edge of said back face is equal to said length of each of said first edge of said triangular bottom part of said bottom part of each gusset and said second edge of said triangular bottom part of said bottom part of each gusset.

* * * * *